US010946998B2

(12) United States Patent
Otxoa-Aizpurua Calvo et al.

(10) Patent No.: US 10,946,998 B2
(45) Date of Patent: Mar. 16, 2021

(54) VERTICAL PACKAGING MACHINE

(71) Applicant: ULMA Packaging Technological Center, S. COOP., Oñati (ES)

(72) Inventors: Alberto Otxoa-Aizpurua Calvo, Oñati (ES); Maitane Ayala Martin, Oñati (ES); Eneko Izquierdo Ereño, Oñati (ES)

(73) Assignee: ULMA PACKAGING TECHNOLOGICAL CENTER, S. COOP., Oñati (ES)

( * ) Notice: Subject to any disclaimer, the term of this patent is extended or adjusted under 35 U.S.C. 154(b) by 239 days.

(21) Appl. No.: 16/026,792

(22) Filed: Jul. 3, 2018

(65) Prior Publication Data

US 2019/0009936 A1 Jan. 10, 2019

(30) Foreign Application Priority Data

Jul. 7, 2017 (EP) ..... 17382443

(51) Int. Cl.
*B65B 9/20* (2012.01)
*B65B 59/00* (2006.01)
(Continued)

(52) U.S. Cl.
CPC ..... *B65B 59/003* (2019.05); *B65B 9/067* (2013.01); *B65B 9/20* (2013.01); *B65B 9/2021* (2013.01);
(Continued)

(58) Field of Classification Search
CPC ..... B65B 9/067; B65B 9/20; B65B 9/2021; B65B 9/2028; B65B 51/26; B65B 51/303; B65B 61/06; B65B 61/188; B65B 59/02
(Continued)

(56) References Cited

U.S. PATENT DOCUMENTS

2017/0113823 A1 4/2017 Wolf et al.

FOREIGN PATENT DOCUMENTS

EP 1495967 A1 1/2005
EP 2128028 A2 12/2009
(Continued)

OTHER PUBLICATIONS

European Search Report and Written Opinion in corresponding European Application No. 17382443.4 dated Jan. 19, 2018.

*Primary Examiner* — Chelsea E Stinson
*Assistant Examiner* — Mary C Hibbert-Copeland
(74) *Attorney, Agent, or Firm* — Edell, Shapiro & Finnan, LLC

(57) ABSTRACT

Vertical packaging machine for generating packages from a film that according to one embodiment includes a film feeder and a forming tube with a longitudinal axis. The forming tube configured to impart a tubular shape to the film. The machine is configured for incorporating a longitudinal tool for longitudinally sealing the longitudinal ends of the tubular-shaped film together and generating a film tube. The machine also includes a module for moving the film tube, and a transverse tool for transversely sealing and cutting the film tube. The module is configured for rotating with respect to the longitudinal axis of the forming tube, being arranged in different operating positions, such that it allows arranging the longitudinal tool required in different positions for generating packages having different topologies and/or different sizes without the need of moving the transverse tool.

20 Claims, 6 Drawing Sheets

(51) Int. Cl.

| | |
|---|---|
| ***B65B 9/067*** | (2012.01) |
| ***B65B 51/26*** | (2006.01) |
| ***B65B 61/18*** | (2006.01) |
| *B65B 61/06* | (2006.01) |
| *B65B 51/30* | (2006.01) |
| *B65B 9/207* | (2012.01) |

(52) U.S. Cl.
CPC ..... *B65B 9/2028* (2013.01); *B65B 51/26* (2013.01); *B65B 61/188* (2013.01); *B65B 9/207* (2013.01); *B65B 51/303* (2013.01); *B65B 61/06* (2013.01)

(58) Field of Classification Search
USPC ..... 53/551
See application file for complete search history.

(56) References Cited

FOREIGN PATENT DOCUMENTS

| | | | | |
|---|---|---|---|---|
| EP | 2664554 | A1 | 11/2013 | |
| FR | 3030459 | A3 * | 6/2016 | ..... B65B 9/2028 |
| FR | 3030459 | A3 | 6/2016 | |
| WO | 2012136325 | A1 | 10/2012 | |
| WO | 2015081919 | A1 | 6/2015 | |

* cited by examiner

VERTICAL PACKAGING MACHINE

CROSS-REFERENCE TO RELATED APPLICATIONS

The present application relates to and claims the benefit and priority to European Appl. No. EP17382443.4, filed Jul. 7, 2017.

TECHNICAL FIELD

The present invention relates to a vertical packaging machine, particularly a vertical packaging machine that can generate different package typologies.

BACKGROUND

Vertical packaging machines are known, comprising a feeder supplying a continuous film, a forming tube receiving the continuous film and suitable for imparting a tubular shape to said film, forming a film tube, and at least one forward movement module for moving the formed film tube in a forward movement direction. The forward movement module comprises at least one driving belt arranged facing the forming tube which, when moved, causes movement of the film tube to an end of the forming tube outlet.

Machines of this type further comprise a longitudinal sealing tool suitable for longitudinally sealing the two longitudinal ends of the film forming the tube, for thereby longitudinally closing the tube, and a transverse sealing and cutting tool for generating a package from the tube, once the products to be packaged have been introduced into the forming tube. Packaging machines of this type are described in patent documents WO2015081919A1 and WO2012136325A1, for example. The former generates a package known as a pillow-type package and variants thereof, and the latter generates a package commonly known as a Doypack and variants thereof.

In machines of this type, access to elements such as the forming tube, the forward movement module, the longitudinal sealing tool and/or the transverse sealing and cutting tool, for example, to replace them, for maintenance work in the work area, and/or for format changes generating another package typology or variants of said package typologies (change in dimensions, functionalities, shapes, designs, etc.), is complex due to the large number of elements existing in the machine, or due to the presence of a conveyor belt which is sometimes arranged facing the forming tube for removing the packages made in the packaging machine and hinders access to said elements.

To change the format of the packages to be generated, for example, in a machine of this type it is common to replace at least the forming tube with a forming tube with the dimensions and contour suitable for the new package format. Patent document EP1495967A1 discloses a packaging machine comprising a support which supports the forming tube with respect to the frame of the packaging machine, the support comprising a first area attached to the forming tube and a second area through which the support is fixed to the frame. The first area can be moved with respect to the second area, such that the forming tube is moved between a first operating position and a second position separated from the first position, in which access to the forming tube is made easier. In both positions, the forming tube is supported by the second area.

Patent document EP2128028A2 discloses a packaging machine designed for simplifying the process of replacing the forming tube. The machine comprises a guide assembly inserting the forming tube while rotating it from the side of the packaging machine. The guide assembly has a main body which supports the forming tube, a first support which supports an end of the main body, and a second support which comprises an arcuate rail guiding the other end of the main body while the forming tube rotating between a work position and a mounting position.

However, the format change sometimes requires not only replacing the forming tube, but also acting on other elements of the packaging machine. In some cases, the format change only requires moving the film tube closer to or away from the different elements involved in generating the packages for adapting them to the new diameter of the forming tube, as occurs in the case disclosed in patent document EP2664554A1, belonging to the same applicant as this application. In this case, the action is further performed in an automatic manner.

However, sometimes, particularly when the format change is done to modify package typology (changing from a pillow-type package to another Doypack-type package, or vice versa, for example), said format change requires movements and orientations of another type of at least one of these other elements, since different package types require different types of actions on the film tube. For example, depending on the package typology, the longitudinal seal in some cases only closes the film tube longitudinally (pillow-type packages, for example), and in other cases, in addition to this function, it also serves as a generator of a reinforcement in one of the walls of the generated package (Doypack-type packages, for example), and to that end it is necessary to modify the orientation of the longitudinal sealing tool with respect to that of the transverse sealing tool and to modify the type of longitudinal sealing tool to be used, among others.

Patent document US2017113823A1, for example, discloses the possibility of rotating the transverse sealing and cutting tool 90°, for format changes of this type. To that end, the machine comprises two guides which enable said rotation. Therefore, by modifying the position from where the film tube is acted on with the transverse sealing and cutting tool, and particularly by modifying the orientation of the transverse sealing and cutting tool with respect to the film tube vis-à-vis the orientation of the longitudinal sealing tool with respect to the film tube, the function of the actual longitudinal seal can be modified, the package typology to be generated by the corresponding packaging machine thereby being modified.

SUMMARY OF THE DISCLOSURE

A vertical packaging machine is provided that is suitable for generating packages from a film, and comprises a film feeder and a forming tube suitable for imparting a tubular shape to a continuous film supplied by the feeder and comprising a longitudinal axis. The machine is configured for incorporating a longitudinal sealing tool suitable for longitudinally sealing longitudinal ends of the tubular-shaped film and generating a film tube, and further comprises at least one forward movement module (preferably two forward movement modules) for vertically driving the film tube, and a transverse sealing and cutting tool for transversely sealing and cutting the film tube, where, after the action of the transverse sealing and cutting tool, a film tube closed at one end upstream of the action and a package separated from the film tube downstream of said action are generated.

The forward movement module is configured for being moved around the forming tube, rotating with respect to the longitudinal axis of the forming tube and being arranged in at least a first end operating position and a second end operating position (it can be arranged in either of them or in any position between both operating positions). Operating position must be interpreted as that angular position with respect to the longitudinal axis of the forming tube from which the forward movement module can act on the film tube to perform its function.

As discussed above, depending on the package typology to be generated, the longitudinal sealing tool to be used is different and can comprise different orientations with respect to the transverse sealing tool. With the proposed invention, the forward movement module can be arranged in a position in which it does not interfere with the required longitudinal sealing tool, and it allows arranging said required longitudinal sealing tool in different operating positions for generating packages having different topologies, therefore having the necessary orientation with respect to the transverse sealing tool, without having to additionally move said transverse sealing and cutting tool as occurs in the prior art (the action of which generates higher inertias and may require oversizing the supports of said transverse sealing and cutting tool or result in a less robust machine). This therefore facilitates a change in package typology to be generated in the machine itself and a simpler format change, obtaining a simplified packaging machine facilitating operational controllability by minimizing the down/change times, etc., and therefore increasing the operating efficiency of the machine.

These and other advantages and features will become evident in view of the drawings and detailed description.

DETAILED DESCRIPTION

Figure 1:
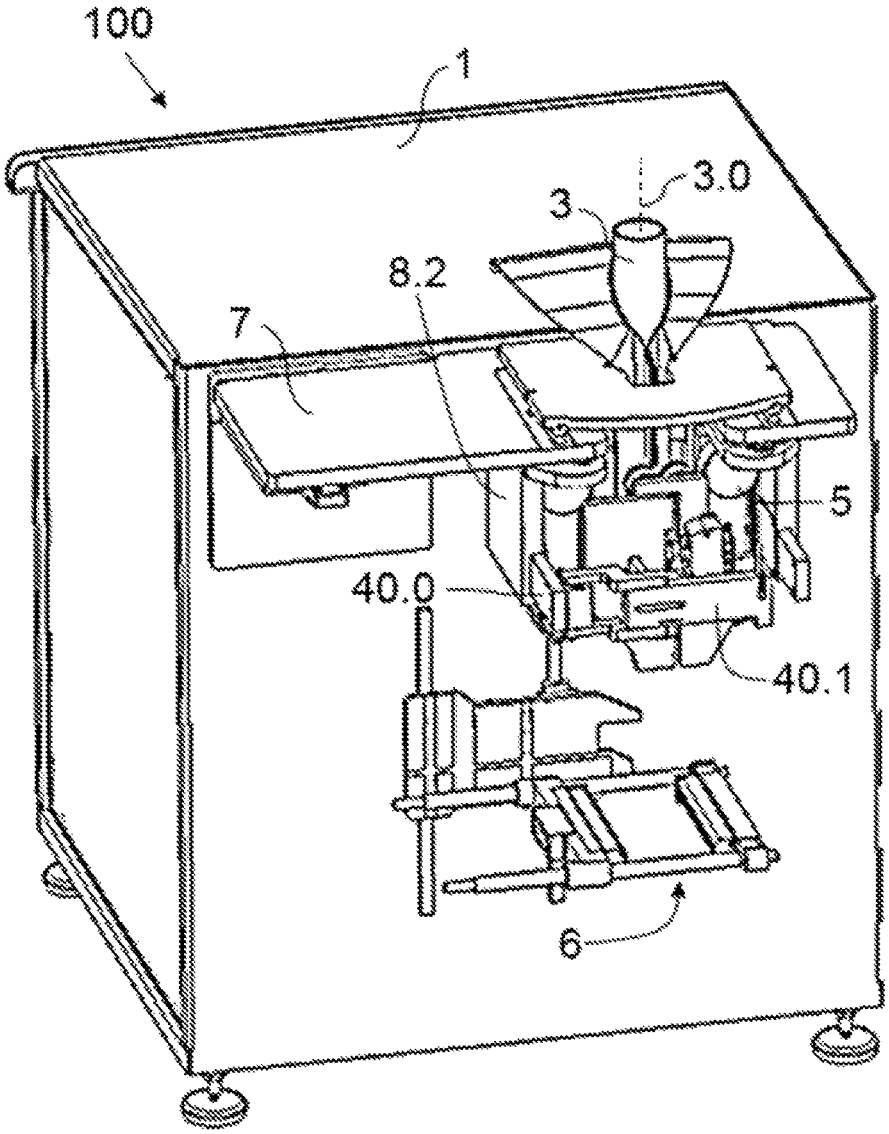
FIG. 1 shows an embodiment of a machine according to one embodiment, with the forward movement module in a first operating position and with a longitudinal sealing tool configured for holding the longitudinal ends of the tubular-shaped film together for sealing them.
Figure 2:
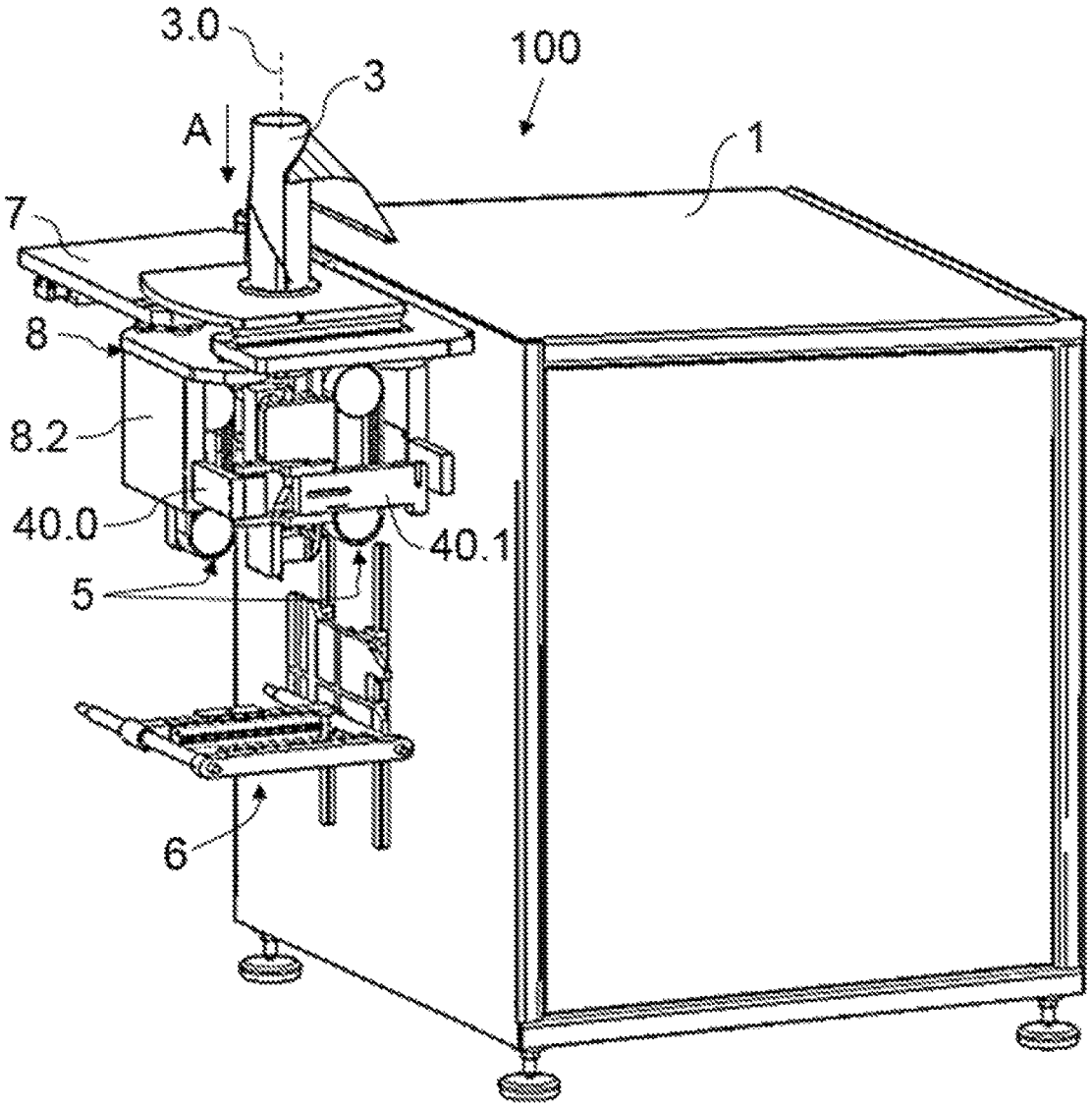
FIG. 2 shows the embodiment of FIG. 1, with the forward movement module in a second operating position and with a longitudinal sealing tool configured for holding the longitudinal ends of the tubular-shaped film against the forming tube for sealing them together.
Figure 3:
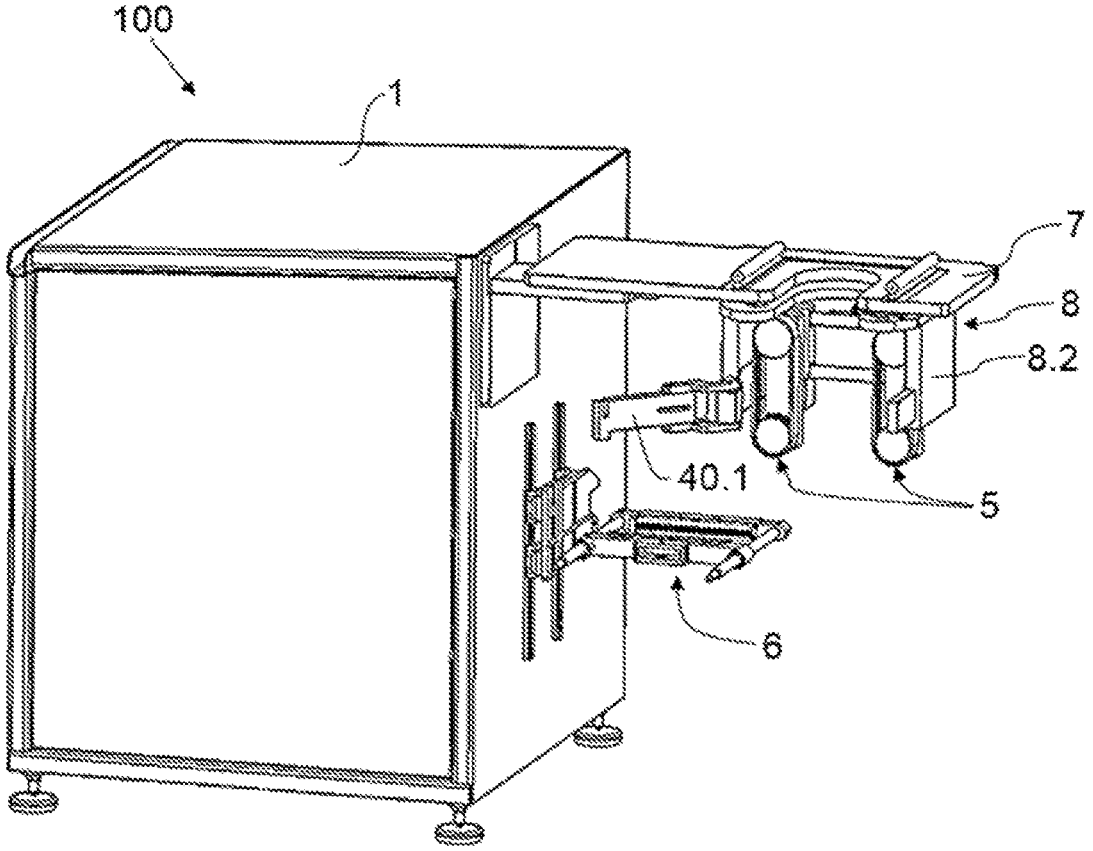
FIG. 3 shows the embodiment of FIG. 1 with the forward movement module in a position for carrying out the format change, without the forming tube and the longitudinal sealing tool, and with a first structure rotated with respect to the frame of the machine.

FIGS. 1 to 3 show an embodiment of a product packaging machine 100 according to one embodiment. The machine 100 comprises a film feeder, not depicted in the drawings, supplying a continuous film, a forming tube 3 which is suitable for receiving the film supplied by the feeder and imparting a tubular shape to same, which feeder is attached to a frame 1 of the machine 100 and comprises a longitudinal axis 3.0. The feeder comprises a shaft on which the film is arranged, wound like a reel, and the rotation of the reel on said shaft unwinds the film, the continuous film thus being supplied in a given supply direction.

The machine 100 is configured for incorporating a longitudinal sealing tool 4.1 or 4.2 suitable for longitudinally sealing longitudinal ends of the tubular-shaped film, thereby generating a film tube, and it further comprises at least one forward movement module 5 which is suitable for vertically driving the film tube in a given forward movement direction A and is facing the forming tube 3, and a transverse sealing and cutting tool 6 for transversely sealing and cutting the film tube, where, after the action of the transverse sealing and cutting tool 6, a film tube closed at one end upstream of the action in the forward movement direction A and a package separated from the film tube downstream of the action in the forward movement direction A are generated.

The forward movement module 5 is configured for being moved around the forming tube 3, rotating with respect to the longitudinal axis 3.0 of the forming tube 3, and for being arranged in a first operating position (such as that shown by way of example in FIG. 1) and a second operating position (such as that shown by way of example in FIG. 2), operating position being understood as that angular position with respect to the longitudinal axis 3.0 of the forming tube 3 from which the forward movement module 5 can act on the film tube or the film. The first operating position and the second operating position are not the only operating positions possible, said first and second operating positions being end operating positions, but the forward movement module 5 can be arranged in any other operating position between said first and second operating positions.

This possibility of rotating the forward movement module 5 allows arranging the required longitudinal sealing tool 4.1 or 4.2 where it should be arranged with respect to the forming tube 3 and transverse sealing tool 6, for sealing the longitudinal ends of the film as appropriate (depending on the package typology to be generated).

In the embodiment shown in the figures, the machine 100 comprises two forward movement modules 5 rotating integrally with one another and preferably arranged facing one another, the forming tube 3 being arranged between both forward movement modules 5. Said forward movement modules 5 vertically drive the film tube by means of a respective belt. Hereinafter, and given that the description is based on the embodiment shown in the drawings (unless otherwise indicated), the presence of two forward movement modules 5 is referred to but it is not a limiting feature.

The machine 100 comprises a first structure 7 to which the forming tube 3 is attached, and a second structure 8 to which the forward movement modules 5 are attached. The first structure 7 is attached to the frame 1 of the machine 100, and the second structure 8 is attached to the first structure 7 with rotational freedom, particularly for rotating with respect to the longitudinal axis 3.0 of the forming tube 3. When the second structure 8 rotates with respect to the first structure 7, the forward movement modules 5 rotate integrally with said second structure 8, thereby rotating with respect to the longitudinal axis 3.0 of the forming tube 3 and changing the operating position. Therefore, to cause a change in the operating position of the forward movement modules 5, rotation of the second structure 8 with respect to the first structure 7 is caused.

Figure 4:
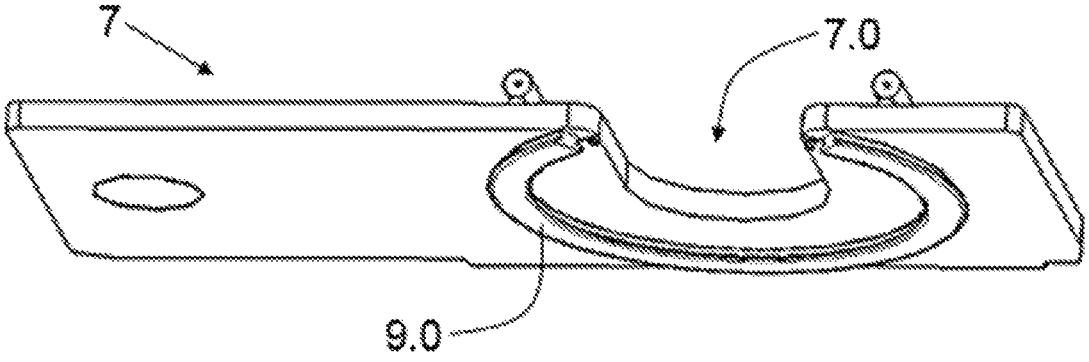
FIG. 4 shows a first structure of the machine of FIG. 1.
Figure 5:
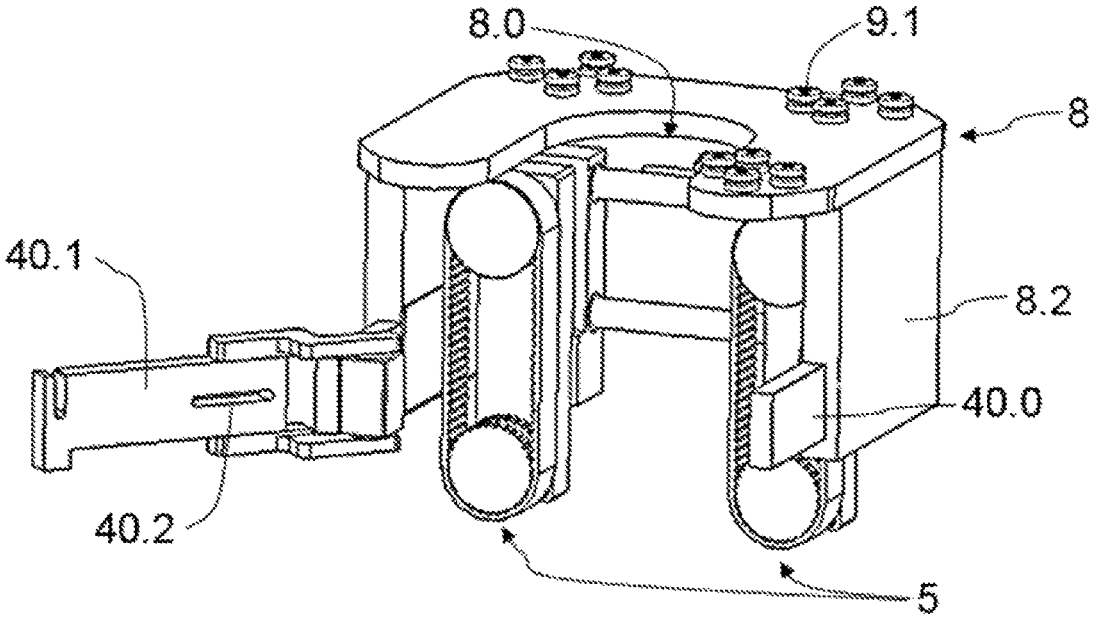
FIG. 5 shows a second structure and the forward movement means of the machine of FIG. 1.

For the rotation of the second structure 8 with respect to the first structure 7, the machine 100 comprises a guiding support 9.0 which is arranged in one of the two structures 7 and 8, preferably in the first structure 7, as shown by way of example in FIG. 4, and comprising at least one guiding groove on one side. The machine 100 further comprises a guide element 9.1 fixed to the other structure 7 or 8 (see FIG. 5, for example), the guide element 9.1 being housed at least partially in the guiding groove, the guide element 9.1 being moved along the guiding groove during rotation of the second structure 8 with respect to the first structure 7. The guide element 9.1 preferably comprises at least one runner or bearing fixed to the other structure 7 or 8 and sliding on the guiding rail.

The forward movement modules 5 are furthermore attached to the second structure 8 with freedom of linear movement, for moving closer to or away from the forming tube 3, said movement therefore being a radial movement with respect to the longitudinal axis 3.0 of said forming tube 3. The forward movement modules 5 are therefore suitable for being moved linearly with respect to the second structure 8 (and moved radially with respect to the forming tube 3), where said movement allows moving the forward movement modules 5 closer to or away from the forming tube 3, in order to arrange same in the radial position suited for the diameter of the corresponding forming tube 3, where it can be adapted in a very simple manner to different package typologies and formats to be generated (different typologies and formats requiring at least different sizes and/or shapes of the forming tube 3). Said linear movement with respect to the second structure 8 is performed by moving the forward movement modules 5 along a respective guide 8.4 arranged in the second structure 8. In some embodiments, the machine 100 comprises an actuator 8.5 which is attached to said second structure 8 and is suitable for causing said simultaneous linear movement of the forward movement modules 5 when required, where the actuator 8.5 could be a hydraulic cylinder-type or electrical-type actuator, for example, controlled by a control device not depicted in the figures, but in other embodiments they could move independently. In other embodiments, said linear movement with respect to the second structure 8 can be caused by hand.

Figure 6:
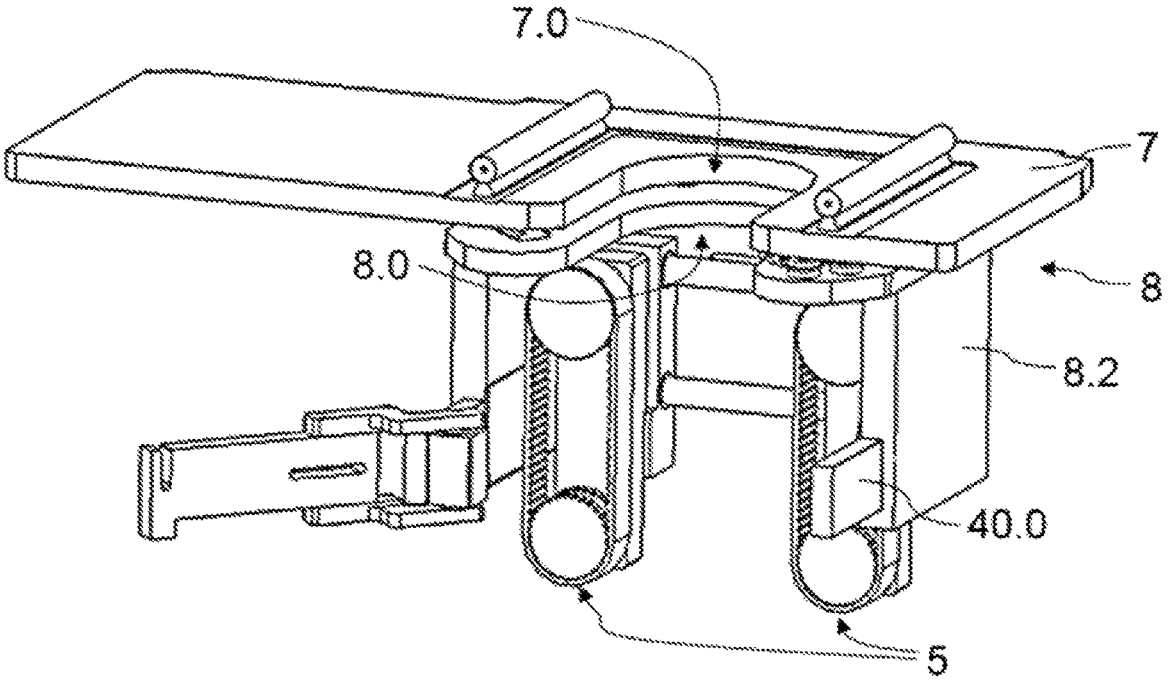
FIG. 6 shows the openings of the two structures of the machine of FIG. 1 aligned.

Each of the structures 7 and 8 comprises a respective opening 7.0 and 8.0 where the forming tube 3 is arranged, the openings 7.0 and 8.0 comprising a minimum width at least equal to the maximum diameter of the forming tube 3 that the machine 100 may comprise to allow radial movement of the forming tube 3 therethrough, for replacement and/or maintenance, for example. Each of the openings 7.0 and 8.0 has one or more closed sides and an open side, and preferably being U-shaped. The first structure 7 is arranged above the second structure 8, and both structures 7 and 8 are configured such that both openings 7.0 and 8.0 vertically coincide in at least one of the operating positions of the forward movement modules 5 (situation shown in FIG. 6, for example), radial movement of the forming tube 3 being allowed in said situation.

In some embodiments, the guiding support 9.0 defines an incomplete circular path, comprising an open section which allows removing the forming tube 3 from the machine 100 between the ends thereof when the openings 7.0 and 8.0 of both structures 7 and 8 vertically coincide. In the first operating position, the openings 7.0 and 8.0 are arranged substantially aligned with one another, and in the second operating position, the recesses 7.0 and 8.0 are arranged oriented substantially at 90° with respect to one another.

When a longitudinal sealing tool 4.1 or 4.2 is arranged in the machine 100, said longitudinal sealing tool 4.1 or 4.2 is attached to the second structure 8, rotating integrally with said second structure 8, together with the forward movement modules 5, with respect to the first structure 7 (see FIGS. 1 and 2, where the second structure 8 is in different angular positions with respect to the first structure 7 and with respect to the transverse sealing and cutting tool 6). The longitudinal sealing tool 4.1 or 4.2 is furthermore attached to the second structure 8 with freedom of linear movement for moving away from and closer to the forming tube 3 in a radial direction, for being adapted to different diameters of forming tubes 3, and for being linearly moved in a direction that is transverse to the radial direction. In some embodiments, this movement is carried out together with the analogous movement of the forward movement modules 5, but in other embodiments both movements are independent of one another (although they may occur simultaneously since they both have to be adapted to the diameter of the forming tube 3).

The machine 100 comprises a tool support to which the longitudinal sealing tool 4.1 or 4.2 is attached when it is incorporated or arranged in the machine 100. The second structure 8 comprises two vertically extending and facing lateral segments 8.2, between which the forming tube 3 is arranged, and the tool support is attached to both lateral segments 8.2 with freedom of linear movement, said tool support being configured for being moved with respect to said lateral segments 8.2 to cause movement of the longitudinal sealing tool 4.1 or 4.2 for moving away from and closer to the forming tube 3 in a radial direction. Each forward movement module 5 is attached to a respective lateral segment 8.2.

The tool support comprises a lateral arm 40.0 for each lateral segment 8.2 of the second structure 8, which is attached to the corresponding lateral segment 8.2 with freedom of linear movement, both arms 40.0 being configured for being linearly moved in a simultaneous manner. The tool support further comprises a transverse segment 40.1 preferably attached to both arms 40.0 and extending between both arms 40.0, being moved integrally therewith in a linear manner with respect to the lateral segments 8.2. The longitudinal sealing tool 4.1 or 4.2 is coupled to the transverse segment 40.1, and said transverse segment 40.1 is configured for allowing longitudinal movement of the corresponding longitudinal sealing tool 4.1 or 4.2 along said transverse segment 40.1, said movement being transverse to the radial direction of said longitudinal sealing tool 4.1 or 4.2 discussed above. To that end, the transverse segment 40.1 can comprise a longitudinal groove 40.2 as a guide for movement thereof and for fixing the longitudinal sealing tool 4.1 or 4.2 to the transverse segment 40.1 after said movement, for example.

Figure 7:
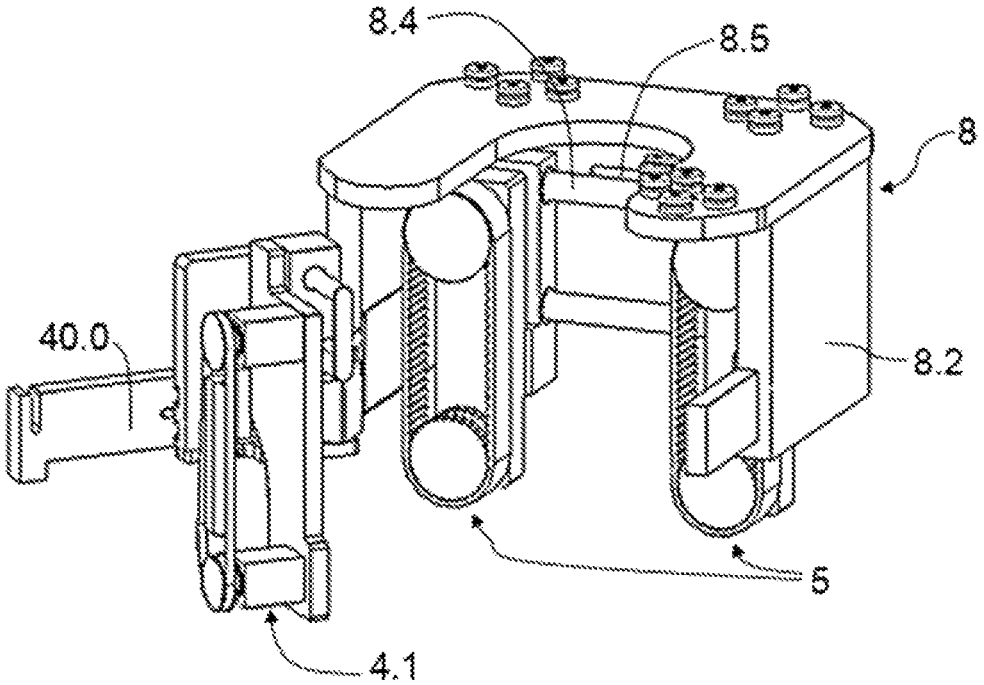
FIG. 7 shows a transverse segment of the machine of FIG. 1, with the longitudinal sealing tool configured for holding the longitudinal ends of the tubular-shaped film against the forming tube for sealing them together.
Figure 8:
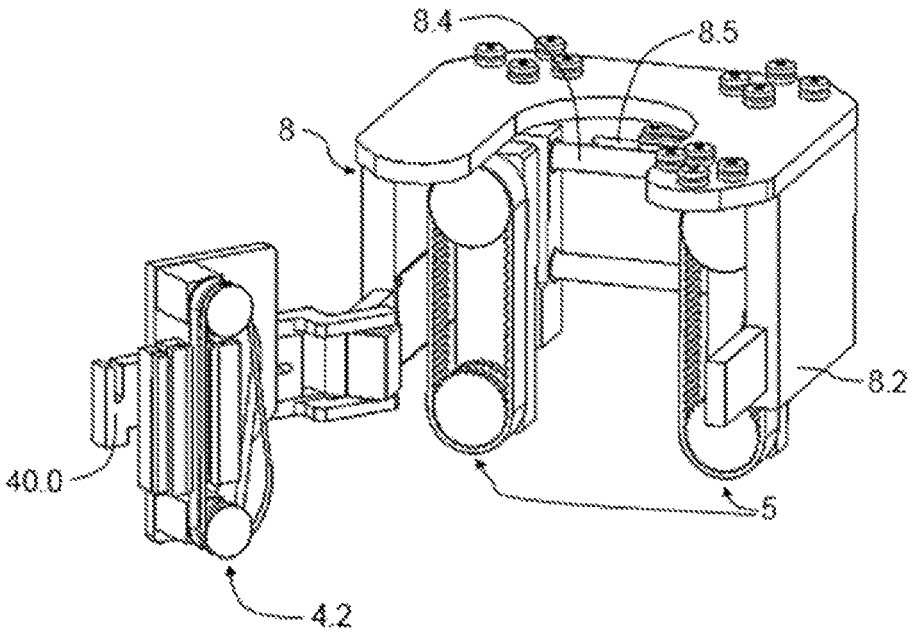
FIG. 8 shows a transverse segment of the machine of FIG. 1, with the longitudinal sealing tool configured for holding the longitudinal ends of the tubular-shaped film together for sealing them.

The transverse segment 40.1 is attached to one of the arms 40.0 with rotational freedom, and it may or may not be coupled to the other arm 40.0 (it is preferably removably coupled to said other arm 40.0, said transverse segment 40.1 being configured for being uncoupled from said arm 40.0). The transverse segment 40.1 is configured for rotating with respect to the corresponding arm 40.0. To cause said rotation, first the transverse segment 40.1 is uncoupled from the corresponding arm 40.0 (if it was in fact coupled), and this rotation causes the transverse segment 40.1 and the longitudinal sealing tool 4.1 or 4.2 attached to said transverse segment 40.1 to no longer be facing the forming tube 3, movement of the forming tube 3 being allowed in that situation (if the openings 7.0 and 8.0 vertically coincide). FIGS. 7 and 8, for example, show the transverse segment 40.1 uncoupled from an arm 40.0 and rotated. With the transverse segment 40.1 thus rotated, replacement thereof is facilitated by means of a transverse movement of the corresponding longitudinal sealing tool 4.1 or 4.2 with respect to the transverse segment 40.1, while at the same time replacement (when required) of the forming tube 3 is also facilitated.

The transverse segment 40.1 is configured for supporting different types of longitudinal sealing tools 4.1 and 4.2, which can be used for generating different package typologies as discussed. For example, it can support a first longitudinal sealing tool 4.2 which is configured for pressing the longitudinal ends of the tubular-shaped film together (for generating Doypack-type packages), and a second longitudinal sealing tool 4.1 is configured for pressing the longitudinal ends of the tubular-shaped film against the forming tube 3 (for generating pillow-type packages). When the forward movement modules 5 are in the first operating position, the first longitudinal sealing tool 4.2 is arranged; when the forward movement modules 5 are in the second operating position, the second longitudinal sealing tool 4.1 is arranged; and when the package to be generated requires arranging the forward movement modules 5 in an intermediate operating position (between the first and second operating positions), the longitudinal sealing tool 4.1 or 4.2 will correspond with what is required for generating said package. Both longitudinal sealing tools 4.1 or 4.2 are suitable for sealing the longitudinal ends of the tubular-shaped film together by pressing said longitudinal ends in a direction substantially parallel to an action direction of the transverse sealing and cutting tool 6.

The machine 100 comprises an actuator (not depicted in figures) for causing the action of the longitudinal sealing tool 4.1 or 4.2 required for sealing the film longitudinally. The longitudinal sealing tool 4.1 or 4.2 required and the transverse sealing and cutting tool 6 are arranged in such a way with respect to the forming tube 3, that they both act against the film and against the film tube, respectively, in radial directions with respect to the forming tube 3, said directions being parallel to one another (horizontal). Depending on the package format or typology to be generated, and therefore the longitudinal sealing tool 4.1 or 4.2 that is used, longitudinal sealing is performed by holding the longitudinal ends of the film tube against the forming tube 3 in a direction transverse to the action direction for acting on said film tube of the forward movement module 5 (configuration of the machine 100 shown by way of example in FIG. 2, and longitudinal sealing tool 4.1 shown in FIG. 7), or longitudinal sealing is performed by holding the longitudinal ends of the film tube together in a direction parallel to the action direction for acting on said film tube of the forward movement module 5 (configuration of the machine 100 shown by way of example in FIG. 1, and longitudinal sealing tool 4.2 shown in FIG. 8). To that end the forward movement modules 5 are arranged in a first operating position or in a second operating position, as indicated above, by means of suitable rotation of the second structure 8 with respect to the first structure 7 (and therefore by means of the rotation of the forward movement module 5 and the corresponding longitudinal sealing tool 4.1 or 4.2). Previously, either before or after changing the operating position, the longitudinal sealing tool 4.1 or 4.2 suitable for the original format is replaced with another longitudinal sealing tool 4.1 or 4.2 suitable for the new format.

The first structure 7 is attached to the frame 1 of the machine 100 with rotational freedom, the second structure 8 being configured for rotating integrally with said first structure 7 when the latter rotates with respect to the frame 1. Therefore, with said first structure 7 in its rotated position, access to the forming tube 3, to the longitudinal sealing tool 4.1 or 4.2 arranged in the machine 100 and/or to the forward movement modules 5 is allowed from one side of the frame 1, when required (see FIG. 3, for example). For example, the packages generated with the machine 100 can be conveyed to the required destination by means of a conveyor belt, and depending on the arrangement of said conveyor belt, it may or may not be advantageous to rotate the first structure 7 with respect to the frame 1 to access the mentioned elements, in order to prevent the conveyor belt from hindering said access for a user. The direction of rotation of the first structure 7 with respect to the frame 1 is preferably the same as the direction of rotation of the transverse segment 40.1 with respect to the corresponding arm 40.0.

In some embodiments not depicted in the figures, the machine 100 comprises an additional feeder for supplying strips of zipper or strips of an equivalent element for generating packages that can be opened and closed several times, with a zipper-type opening/closure or an equivalent. When the forward movement module 5 is arranged in the first operating position, said additional feeder is configured for arranging a continuous strip of zipper (or a strip of an equivalent element such as Velcro or the like, for example) in the tubular-shaped film, said strip being parallel to the longitudinal axis of the forming tube 3 and aligned with the first longitudinal sealing tool 4.2, and said first longitudinal sealing tool 4.2 being suitable for sealing the continuous strip of zipper (or an equivalent element) to the tubular-shaped film. When the forward movement module 5 is arranged in the second operating position, said additional feeder is configured for sealing strips of zipper (or strips of an equivalent element) to the tubular-shaped film, and for arranging said strips of zipper (or an equivalent element) transversely with respect to the longitudinal axis of the forming tube 3 and separated from one another a given distance. The additional feeder used in either case can be different, requiring the deactivation/activation or the replacement of one with another when the package topology to be generated is changed.

In summary, the invention allows rotating the forward movement modules 5 around the forming tube 3, rotating with respect to the longitudinal axis 3.0 of the forming tube 3, between a first operating position and a second operating position. For generating said rotation, rotation of the second structure 8 of the machine 100 with respect to the first structure 7 is caused.

Being able to rotate the forward movement modules 5 allows, for example, modifying the package typology to be generated in the machine 100 in a simple manner, since it allows changing the position of the longitudinal sealing tool directly. The invention thereby facilitates a simpler change in package typology to be generated in the machine 100 itself, obtaining a more robust and simplified packaging machine 100, facilitating operational controllability by minimizing the down/change times, etc., and therefore increasing the performance of the machine 100.

During a format change in the machine 100, different operations that can be carried out in different orders are performed with different elements, and they are explained below by way of example.

Forward Movement Modules 5:

Once the forward movement modules 5 are arranged in the corresponding operating position, they are adjusted to the new forming tube 3 should the format change have required a change in the forming tube 3 (a forming tube 3 with a larger or smaller diameter). To that end, the forward movement modules 5 are moved linearly with respect to the second structure 8 in a radial direction with respect to the forming tube 3, in order to adjust the distance of the modules with respect to the forming tube 3 and said modules are thereby adjusted to the new diameter of the forming tube 3.

Forming Tube 3:

A format change often requires a change in the forming tube 3, since a forming tube 3 having a larger or smaller diameter may be required. The steps required for changing a forming tube 3 according to the method of the invention are described below.

As discussed, each of the two structures 7 and 8 of the machine 100 comprises a respective opening 7.0 and 8.0 for housing the forming tube 3, which is preferably U-shaped. If both openings 7.0 and 8.0 do not vertically coincide, rotation of the second structure 8 with respect to the first structure 7 is caused so that both openings coincide and movement of the forming tube 3 therethrough is allowed. In addition, and before or after vertically aligning the openings 7.0 and 8.0, rotation of the longitudinal sealing tool 4.1 or 4.2 arranged in the machine 100 with respect to the second structure 8 is caused, such that it is no longer facing the forming tube 3, and particularly it is no longer in the path of travel of the forming tube 3 as the latter is moved through the openings 7.0 and 8.0. The machine 100 preferably comprises an tool support with a transverse segment 40.1, as discussed above, and rotation of said transverse segment 40.1 with respect to said second structure 8 (particularly with respect to one of the arms 40.0 of said tool support) is caused. With the openings 7.0 and 8.0 aligned vertically and with the longitudinal sealing tool 4.1 or 4.2 required arranged in the machine 100 and thus rotated, the forming tube 3 is radially moved through said openings 7.0 and 8.0, discharging it from the machine 100, and the new forming tube 3 is introduced in the machine 100. Then rotation of the longitudinal sealing tool 4.1 or 4.2 in the opposite direction is caused to arrange it facing the forming tube 3.

Longitudinal Sealing Tool:

A change in package typology also requires a change in the longitudinal sealing tool. The longitudinal sealing tool 4.1 holding the longitudinal ends of the tubular-shaped film against the forming tube 3 for sealing them together, in an action direction that is substantially parallel to the action direction of the transverse sealing and cutting tool 6, as shown by way of example in FIGS. 2 and 7, is commonly used for generating pillow-type packages, such that the forward movement modules 5 are arranged in the second operating position. However, the longitudinal sealing tool 4.2 holding the longitudinal ends of the tubular-shaped film together for sealing them, as shown by way of example in FIGS. 1 and 8, is used for generating Doypack-type packages, such that the forward movement modules 5 are arranged in the first operating position.

To replace a longitudinal sealing tool, the transverse segment 40.1 is rotated and said longitudinal sealing tool is moved until it is removed from said transverse segment 40.1 and replaced with the new longitudinal sealing tool.

During a format change, either for making a package having the same typology (but a different diameter) or for generating a package having a different typology, the corresponding longitudinal sealing tool 4.1 or 4.2 rotates integrally with the forward movement modules 5 for being arranged in their operating position. Once in said operating position, and with the new forming tube 3 now installed in the machine 100, said longitudinal sealing tool 4.1 or 4.2 is moved linearly with respect to the second structure 8 in a radial direction in order to adjust the distance of the module with respect to the forming tube 3 and said module is thereby adapted to the new diameter. To that end, movement of the tool support of the machine 100 in the radial direction is caused, the longitudinal sealing tool 4.1 or 4.2 which is attached to said tool support likewise being moved.

Furthermore, should it be required, the longitudinal sealing tool 4.1 or 4.2 is moved linearly with respect to the second structure 8 in a direction that is transverse to the radial direction, along the transverse segment 40.1, to arrange it facing the required area of the film tube (the center or leaning towards one end of the forming tube 3 or the other). Additionally, should a change in the longitudinal sealing tool 4.1 or 4.2 be required, by prolonging this linear movement out of the transverse segment 40.1 said longitudinal sealing tool 4.1 or 4.2 is uncoupled from said transverse segment 40.1, which allows coupling a new longitudinal sealing tool 4.1 or 4.2 for the new package format to be generated.

The invention claimed is:

1. A vertical packaging machine for generating packages from a film, the machine comprising:

a forming tube having a longitudinal vertical axis and configured to impart a tubular shape to the film to create a tubular-shaped film having longitudinal ends;

a longitudinal sealing tool that is configured to longitudinally seal the longitudinal ends of the tubular-shaped film to generate a film tube;

a first forward movement module configured to vertically move the film tube in a downward direction, the first forward movement module being rotationally moveable around the forming tube with respect to the longitudinal vertical axis of the forming tube between different positions, the longitudinal sealing tool arranged to move with the first forward movement module when the first forward movement module moves around the forming tube;

a transverse sealing and cutting tool being configured to produce a first transverse seal and a second transverse seal in the film tube, and to perform a transverse cut between the first and second transverse seals;

the longitudinal sealing tool being movable around the forming tube to facilitate the generating of packages having different topologies, the first forward movement module and longitudinal sealing tool being arranged in a manner that permits the longitudinal sealing tool to be moved around the forming tube without having to move the transverse sealing and cutting tool around the forming tube.

2. The vertical packaging machine according to claim 1, further comprising a first structure to which the forming tube is attached and a second structure to which the first forward movement module is attached, the first structure being attached to a frame of the vertical packaging machine and the second structure being attached to the first structure in a manner that allows the second structure to rotate with respect to the first structure, the first forward movement module rotating with respect to the longitudinal vertical axis of the forming tube when the second structure rotates.

3. The vertical packaging machine according to claim 2, further comprising one or more guide elements that are fixed to the first structure or to the second structure, the other of the first structure or second structure that does not include the one or more guide elements having a guiding groove, the one or more guide element being housed at least partially in the guiding groove with a freedom of movement to facilitate the rotation of the second structure with respect to the first structure.

4. The vertical packaging machine according to claim 3, wherein the first forward movement module is coupled to the second structure in a manner that allows the first forward movement module to be moved towards and away from the forming tube.

5. The vertical packaging machine according to claim 3, wherein each of the first structure and second structure includes a respective first through opening and second through opening through which the form tube passes, each of the first and second through openings being closed on one or more sides and open on one side, the first and second through openings being configured such that when the open sides of the first and second through openings are not vertically aligned the forming tube is prevented from being horizontally removed from the first and second through openings, and such that when the open sides of the first and second through openings are vertically aligned the forming tube is able to be horizontally removed from the first and second through openings through the open sides.

6. The vertical packaging machine according to claim 5, wherein the guiding groove defines an incomplete circular path, comprising an open section which allows the horizontal removal of the forming tube from the vertical packaging machine when the first and second through openings are vertically aligned.

7. The vertical packaging machine according to claim 5, wherein the different positions of the first forward movement module include a first position wherein the open sides of the first and second through openings are arranged substantially vertically aligned and a second position wherein the open sides of the first and second through openings are arranged oriented substantially at 90° with respect to one another.

8. The vertical packaging machine according to claim 5, wherein the first and second through openings are U-shaped.

9. The vertical packaging machine according to claim 8, comprising a tool support to which the longitudinal sealing tool is attached, the second structure comprising first and second spaced-apart vertically extending lateral segments between which the forming tube is arranged, the tool support being coupled to each of the first and second lateral segments with a freedom movement to be moved toward and away from the forming tube.

10. The vertical packaging machine according to claim 9, wherein the tool support comprises a first arm that is coupled to the first lateral segment and a second arm coupled to the second lateral segment, each of the first and second arms being respectively coupled to the first and second lateral segments with a freedom movement to be moved toward and away from the forming tube, the forming tool further comprising a transverse segment extending between and attached to the first and second arms, the longitudinal sealing tool being coupled to the transverse segment in a manner that permits the longitudinal sealing to be moved towards and away from the first and second arms.

11. The vertical packaging machine according to claim 10, wherein the transverse segment is attached to one of the first and second arms in a manner that permits the transverse segment to rotate with respect to the one of the first and second arms.

12. The vertical packaging machine according to claim 10, wherein the longitudinal sealing tool is configured to press the longitudinal ends of the tubular-shaped film together.

13. The vertical packaging machine according to claim 10, wherein the longitudinal sealing tool is configured to press the longitudinal ends of the tubular-shaped film against the forming tube.

14. The vertical packaging machine according to claim 9, wherein the first forward movement module is attached to the first lateral segment.

15. The vertical packaging machine according to claim 14, further comprising a second forward movement module attached to the second lateral segment, the second forward movement module configured to vertically move the film tube in a downward direction toward the transverse sealing and cutting tool, the first and second forward movement modules being moveable around the forming tube with respect to the longitudinal axis of the forming tube between different positions, the longitudinal sealing tool arranged to move with the first and second forward movement modules when the first and second forward movement modules move around the forming tube.

16. The vertical packaging machine according to claim 3, wherein the one or more guide element are fixed to the second structure and the first structure includes the guiding groove, the longitudinal sealing tool being coupled to the second structure and rotating with the second structure together with the first forward movement module.

17. The vertical packaging machine according to claim 2, wherein the first structure is attached to the frame of the vertical packaging machine in a manner that permits the first structure to rotate with respect to the frame.

18. The vertical packaging machine according to claim 17, wherein when the first structure rotates with respect to the frame the second structure rotates with the first structure.

19. The vertical packaging machine according to claim 1, further comprising a film feeder that is configured to supply the film to the forming tube.

20. The vertical packaging machine according to claim 19; further comprising an additional feeder which is configured for arranging a continuous strip of zipper or equivalent element in the tubular-shaped film.

* * * * *